United States Patent [19]

Nattrass

[11] Patent Number: 4,493,109

[45] Date of Patent: Jan. 8, 1985

[54] FLEXIBLE BULK CONTAINER WITH INTEGRAL LIFTING LOOPS

[76] Inventor: Frank Nattrass, Fallows End, Brearton, Harrogate, N. Yorkshire HG3 3BX, England

[21] Appl. No.: 471,017

[22] Filed: Mar. 1, 1983

[30] Foreign Application Priority Data

Mar. 1, 1982 [GB] United Kingdom ..... 8205961

[51] Int. Cl.[3] ..... B65D 88/16; B65D 90/00; B65D 33/14; B65D 33/02

[52] U.S. Cl. ..... 383/7; 383/17; 383/24; 383/119; 493/226; 493/926; 493/967

[58] Field of Search ..... 383/17, 18, 24, 119, 383/8, 7; 428/542.8; 493/226, 231, 926, 967

[56] References Cited

U.S. PATENT DOCUMENTS

| | | | |
|---|---|---|---|
| 724,316 | 3/1903 | Morris et al. | 383/18 |
| 3,607,521 | 9/1971 | Suominen et al. | 493/926 X |
| 4,191,229 | 3/1980 | Skaadel et al. | 383/8 X |
| 4,207,937 | 6/1980 | Sandemann et al. | 383/119 X |
| 4,221,321 | 9/1980 | Langen et al. | 493/226 X |
| 4,300,608 | 11/1981 | Cuthbertson | 383/18 X |
| 4,393,910 | 7/1983 | Rasmussen | 383/8 |

FOREIGN PATENT DOCUMENTS

| | | | |
|---|---|---|---|
| 0041586 | 12/1981 | European Pat. Off. . | |
| 2,727,441 | 3/1979 | Fed. Rep. of Germany | 383/17 |
| 2824940 | 12/1979 | Fed. Rep. of Germany | 383/24 |
| 327647 | 4/1930 | United Kingdom . | |
| 2059915 | 4/1981 | United Kingdom . | |
| 1590942 | 6/1981 | United Kingdom . | |
| 1591091 | 6/1981 | United Kingdom . | |

*Primary Examiner*—William Price
*Assistant Examiner*—Sue A. Weaver
*Attorney, Agent, or Firm*—Norbert P. Holler; Bert J. Lewen

[57] ABSTRACT

A flexible bulk container assembled from a single length of material. The container comprises a base (5), first and second opposed side walls (6,7) each joined to the base and third and fourth opposed side walls each composed of two panel sections (8,9 and 10,11 respectively) joined along a vertical center seam, each third and fourth side wall being joined to the first and second side walls and to the base. Each side wall has two spaced parallel reinforcing bands (2,3) extending from the bottom to the top thereof, each band being extended above the top of the side wall into a connection section that connects with the closer reinforcing band of the adjacent side wall to form a lifting loop (12 to 14) over the respective corner of the container. Each connecting section is a continuous extension of the two reinforcing bands that it connects, so avoiding stitching of the lifting loops to the wall fabric.

9 Claims, 6 Drawing Figures

FLEXIBLE BULK CONTAINER WITH INTEGRAL LIFTING LOOPS

Figure 1:
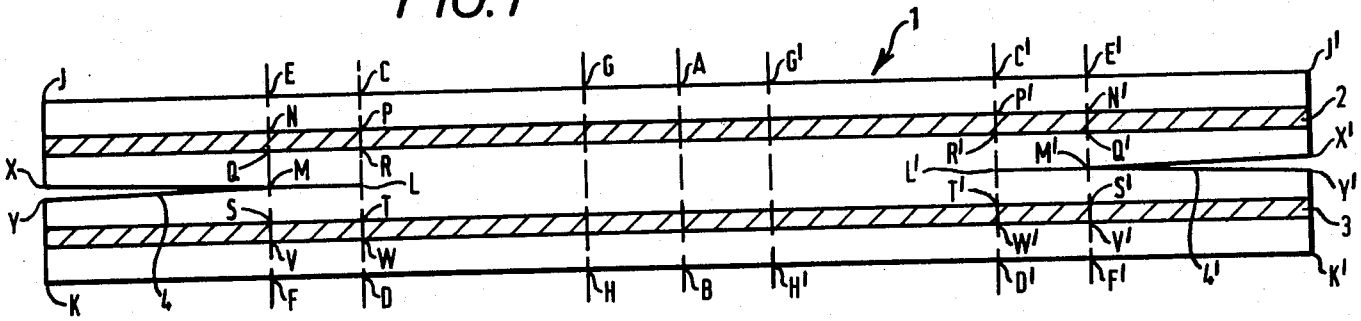
Figure 2:
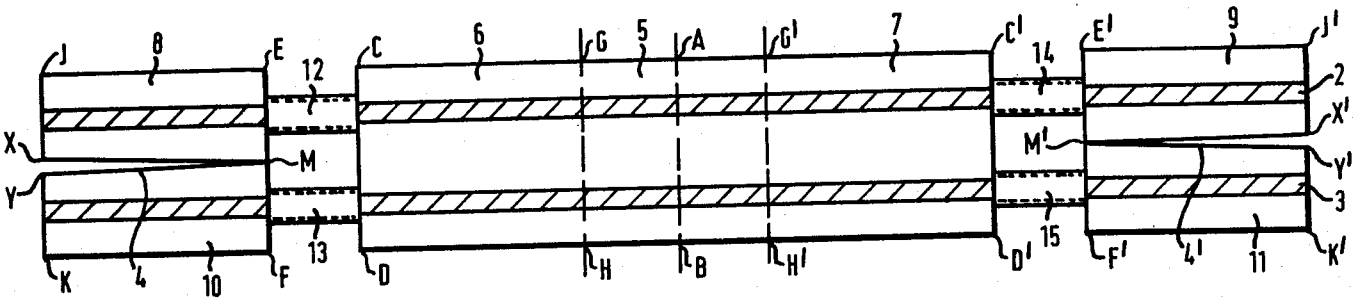

This invention relates to flexible bulk containers such as are used in the storage and transport of materials in granular, powder and other particulate form.

Such containers are generally in the form of large bags or sacks which are often required to carry loads of up to one tonne or more, with considerable safety margin above this working load. The containers are commonly made from woven fabric, particularly woven polypropylene or other suitable synthetic material.

There have in the past been many proposals for providing such containers with lifting loops at the upper part of the container. In the most commonly used constructions the lifting loops are loops of high strength webbing which are stitched to the side walls of the container, desirably so that there is reinforcement in the area where stitching occurs. For example, the side walls fabric may be folded so that each loop is stitched to a plurality of thicknesses of the material. In another known arrangement each loop may be stitched to the side wall in a region where the side wall fabric is reinforced.

The points of attachment of the lifting loops to the side walls are generally regions of high stress concentration, and despite reinforcement the areas surrounding the loop connections are the commonest failure areas for these containers. This is particularly the case where the container is mishandled, for example lifted or pulled with only a single loop of the container engaged by the lifting or pulling means. The object of the invention is to provide a container which will overcome these disadvantages.

According to the present invention I provide a flexible bulk container having a base and four side walls each joined to the base and to the two adjacent side walls, the container being formed from a single elongated strip of woven fabric of width substantially equal to the side wall width, the strip having two spaced parallel reinforcing bands extending longitudinally thereof and forming an integral part of the fabric, each band extending the full length of the strip and lying between the longitudinal centre line and a respective longitudinal edge of the strip, the strip having been cut away to leave connecting sections between strip sections that will form the side walls of the container, each connecting section comprising a length of reinforcing band, the strip having been folded and stitched to form the container and to locate the connecting sections so that each extends between adjacent side panels over a respective corner of the bag and forms a lifting loop at the corner of the bag.

By arranging that each connecting section is an integral continuous extension of the two reinforcing bands of adjacent side walls it will be seen that there is no stitched connection whatsoever between the individual lifting loops and the side walls of the container. Apart from avoiding the operation of stitching the loops to the container side walls this arrangement avoids the stress concentrations at the stitching points and significantly improves the distribution of stress from the lifting loops over the container side wall fabric.

Preferably, opposed first and second side walls of the container are continuous extensions of the base, and each of opposed third and fourth side walls comprises two panels, each panel containing part of one of the reinforcing bands, the two panels being stitched together along a seam extending upwardly along the centre of the respective side wall and also being stitched to the base. This construction facilitates manufacture of the container as will hereafter be described. If each panel is also stitched along its upwardly extending edge to the upwardly extending edge of the adjacent one of the opposed first and second side walls manufacture is further facilitated.

The parts of the strip that have been cut away are preferably wrapped around the connecting sections, to which they remain joined, and stitched thereto in order to give protection to those connecting sections in the respective lifting loops. It may be desirable to incorporate a strip of resiliently flexible material in the wrapped connecting section in order that each loop can recover to a position standing proud of the top of the bag.

The invention further extends to a blank from which may be assembled a flexible bulk container having a base, four side walls extending upwardly from the base and four lifting loops each extending between adjacent side walls at a respective corner of the bag, the blank comprising an elongated strip of material of width substantially equal to the required base width and side wall width of the container, the strip having two spaced parallel reinforcing bands extending longitudinally thereof, each band extending the full length of the strip and lying between the longitudinal centre line and a respective longitudinal edge of the strip, the strip having a length that is at least equal to the base length plus four times the side wall height plus twice the lifting loop length of the container to be assembled, the blank, to each side of a notional transverse line that will be the transverse centre line of the base of the assembled container, extending continuously to a second notional transverse line for a distance equal to half the base length plus the side wall height and being formed with a central longitudinal cut extending from that second notional transverse line to the end of the strip.

At a later stage of assembly the blank is desirably modified so that between the second notional transverse line and a third notional transverse line lying between the second line and the adjacent end of the strip and spaced from the second line by the lifting loop length, the base fabric is cut, except over the width of the reinforcing bands.

In a further subsequent stage the blank is desirably such that the cut base fabric attached to each reinforcing band is wrapped around that band and is stitched thereto.

Finally, the invention also extends to a method of assembling a flexible bulk container having a base, four side walls extending upwardly from the base and four lifting loops, each extending between adjacent side walls at a respective corner of the container, the method comprising providing a blank, comprising an elongated strip of material of width substantially equal to the required base width and side wall width of the container, the strip having two spaced parallel reinforcing bands extending longitudinally thereof, each band extending the full length of the strip and lying between the longitudinal centre line of the strip and a respective longitudinal edge of the strip, the strip having a length that is at least equal to the base length plus four times the side wall height plus twice the lifting loop length, defining on the blank a first notional transverse line that will be the transverse centre line of the base, defining to each side of the first notional transverse line a second notional transverse line spaced from said first line by a distance equal to half the base length plus the side wall height, defining to each side of the first notional transverse line a third notional transverse line lying between the respective second notional transverse line and the adjacent end of the strip and spaced from the respective second notional transverse line by a distance equal to the lifting loop length, defining to each side of the first notional transverse line a fourth notional transverse line lying between the first line and adjacent second line at a distance from the first line equal to half the base length, effecting a central longitudinal cut from each second notional transverse line to the adjacent end of the strip, cutting the blank along each second and third notional transverse line except over the width of the reinforcing bands, wrapping the cut base fabric around the respective reinforcing band to which it is attached and stitching it thereto, folding the strip so that each end is moved into contact with the adjacent fourth notional transverse line and stitching together the two overlying plies of material along each edge of the strip, folding each corner defined by the junction of the longitudinal cut and the end of the strip to lie on the first notional transverse line, stitching the respective part of the end of the strip to the side of the strip between the first and fourth notional transverse lines, and stitching together along their respective longitudinal cuts the two panels folded in from the respective ends of the strip at the same side thereof to form a central seam extending up the centre of the container side wall formed by those panels.

Although the foregoing statement sets forth the preferred sequence of steps it will be understood that the sequence may be changed without detracting from the ease with which the container may be assembled.

The strip of material that forms the blank and that forms the finished container is desirably a continuous strip, although it could if required be assembled from a number of strip elements stitched together either longitudinally or transversely or both of the finished strip. Obviously, however, a continuous strip will give maximum strength. The reinforcing bands may be constituted in any convenient manner. For example, they may be bands separate from the strip material and secured in the appropriate positions to that material in any suitable way. The material of the strip and of the reinforcing bands must be chosen so that the finished container will have the required strength. Preferably the material both of the strip and of the bands will be a woven fabric, although in some cases this may not be essential. When a woven fabric is used it is particularly preferred that the reinforcing bands constitute an integral part of the strip. This can readily be achieved by appropriate weaving techniques and reinforcing bands may be provided, for example, by the cramming of warp threads in the region of the reinforcing band, i.e. by making the warps per centimeter in the reinforcing band regions greater than the number of warps per centimeter in the base fabric of the strip. Alternatively, the reinforcing bands may incorporate warp yarn of a higher tensile strength than the warp yarns of the base fabric. These higher strength yarns may replace entirely the warp yarns used for the base fabric or they may be used in addition to those warp yarns so that each reinforcing band will incorporate both base fabric warp yarns and higher strength warp yarns.

In a preferred arrangement the material of the blank may be a woven fabric having polypropylene warp and weft yarns interwoven in any appropriate weaving pattern, usually smoothwoven, although twill, basket and rib weaves may also be used. Interwoven with the polypropylene weft yarns in the regions of the reinforcing bands are additional reinforcing warp threads having a higher tensile strength than the base polypropylene warp threads. The reinforcing threads may be made from any suitable natural fibre or from a yarn of synthetic or semi-synthetic polymer, such as polyester, polyamide, polyolefin or polyacrilic. The higher strength warp yarns may alternatively also be of polypropylene which may be of a higher count than the base polypropylene yarns or may be a yarn similar to the base yarn that has been treated, i.e. by fibrilation, in order to increase its tensile strength. The suggested materials given in this paragraph is not an exhaustive list and other materials will be apparent to those skilled in the art.

In order that the invention may be better understood the assembly from a blank of a specific embodiment of container in accordance with the invention will now be described in more detail, by way of example only, with reference to the accompanying drawings in which FIGS. 1 to 6 show successive stages of manufacture of a container.

Referring now to FIG. 1 this shows a rectangular blank in the form of an elongated strip of material 1 of width substantially equal to the required base width and side wall width of the container to be assembled from the blank. The strip has two spaced parallel reinforcing bands 2, 3 extending longitudinally the full length of the strip, each band lying between the longitudinal centre line of the strip and a respective longitudinal edge of the strip.

The blank may be marked to define a first notional transverse line A-B that will be the transverse centre line of the base of the assembled container. To each side of the line A-B the following operations are identical, and references applying to the right of the line A-B are thus shown the same as those to the left, but with a prime (′). To the left of the line A-B the blank may be marked to define a second notional transverse line C-D, a third notional transverse line E-F and a fourth notional transverse line G-H. The distance from the line A-B to the line G-H is equal to half the base length, the distance from the line G-H to the line C-D is equal to the side wall height, the distance from the line C-D to the line E-F is equal to the length of the lifting loop and the distance from the line E-F to the end of the blank at corners J-K is equal to the side wall height. If desired the original strip blank may be slightly longer than the length J—J′ so that the ends of the strip may be hemmed, the blank being of the length J—J′ after hemming.

After marking as required a longitudinal cut 4 is made from the mid-point L of the second notional transverse line C-D to the adjacent end of the strip. From the mid-point M of the third notional transverse line E-F material may be removed so that the cut tapers outwardly to the ends of the fabric as shown in FIG. 1, although the cut may be a simple cut without removing fabric or may be a fabric-removing tapered cut that is wider at the line E-F than it is at the end of the fabric. Use of a tapered cut allows slight shaping of the container. A corresponding cut 4′ is made at the outer end of the strip.

Cuts are then made along the second and third notional transverse lines from points E to N, Q to S, V to F, C to P, R to T and W to D, corresponding cuts again being made at the opposite end of the strip. The resulting panels of base fabric CENP and RQML remain attached to the reinforcing band 2 which does of course remain uncut. Similarly, panels MSTL and VFDW remain attached to the reinforcing band 3 and similar panels remain attached at the other end of the strip. The panels CENP andd RQML are then wrapped around the attached length of the reinforcing strip 2 and are stitched in position. If desired a strip of flexible, resilient material may be incorporated in a pocket formed by this folding and stitching operation. A similar operation is carried out on the other three corresponding locations of the blank and at the end of this the blank is then of the form shown in FIG. 2. In this condition the blank can be considered as having panels as follows:

a panel 5 defined by G G' H H' that will form the base of the container, a panel 6 defined by CGHD that will form a first side wall of the container, a panel 7 defined by G' C' D' H' which will form a second side wall opposed to the first side wall, a panel 8 defined by JEMX that will form half a third side wall, a panel 9 defined by J' E' M' X' that will form the other half of the third side wall, a panel 10 defined by MFKY which will form half a fourth side wall lying opposite to the third side wall and a panel 11 defined by M' F' K' Y' which will form the other half of the fourth side wall. Panels 6 and 8 are joined by connecting section 12, panels 6 and 10 are joined by connecting section 13, panels 7 and 9 are joined by connecting section 14 and panels 7 and 11 are joined by connecting section 15, the length of reinforcing band in each connecting section being in each case a continuous extension of the reinforcing band in the respective panels.

Figure 3:
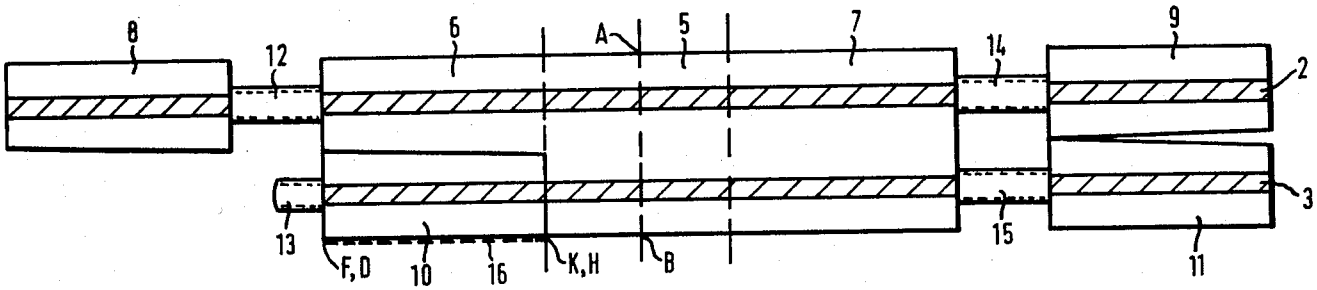
Figure 4:
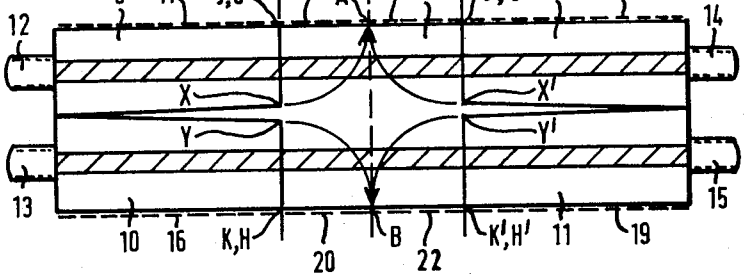
Figure 5:
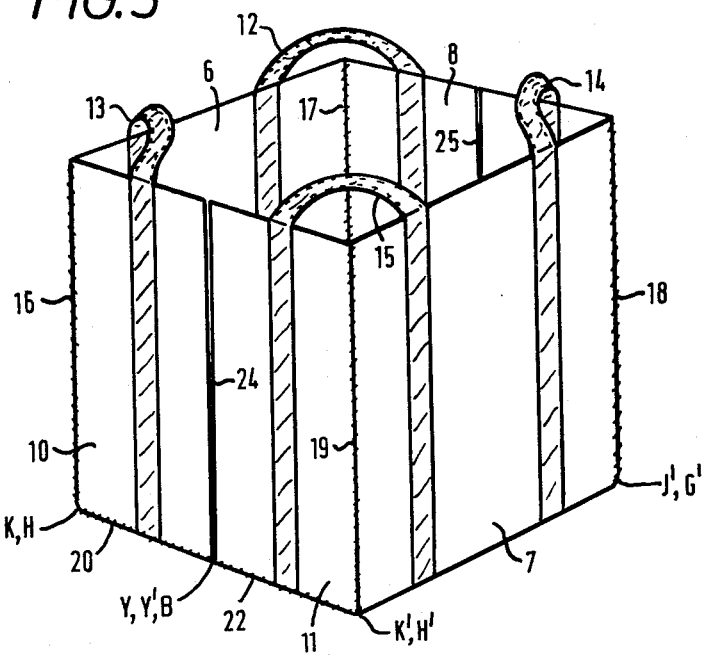

The next stage of assembly is illustrated by FIG. 3. Panel 10 is folded over about the connecting section 13 so that point K overlies point H and point F overlies point D. The two panels are then stitched together along a line 16 at the edge of the blank. Panel 8 is then similarly folded onto panel 6, panel 9 onto panel 7 and panel 11 onto panel 7, stitching being effected along lines 17, 18 and 19. The resultant structure is shown in FIG. 4. From this position the blank is folded so that point Y is moved over to point B and edges HB and KY are stitched together along line 20. Similarly, point X is folded to point A and edges JX and GA are stitched together along line 21. Point Y' is folded over to point B and the edges K'Y' and H'B stitched together, and point X' is folded over to point A and edges J'X' and G'A are stitched together. The blank is then in the form shown in FIG. 5. Assembly is then completed by stitching together along line 24 the panels 10 and 11 and by stitching together along line 25 the panels 8 and 9.

It will be seen that the finished container comprises a base and four side walls, two of those side walls 6, 7 being continuous with the base and the reinforcing bands 2, 3 of those side walls extending through the base. The other two opposed side walls are each made up of two panel sections joined by a vertical centre seam, panel sections 10 and 11 forming one side wall and panel sections 8 and 9 forming the opposite side wall. A lifting loop extends over each top corner of the container, each loop being formed by one of the connecting sections 12 to 15 and thus being integral with the reinforcing bands in the side walls so resulting in an extremely strong structure with excellent stress transfer from the lifting loops to the side walls of the container. Indeed it is found that a container manufactured in this way can have an extremely high factor of safety and that it can readily stand misuse by being lifted or pulled with only a single loop engaged.

Figure 6:
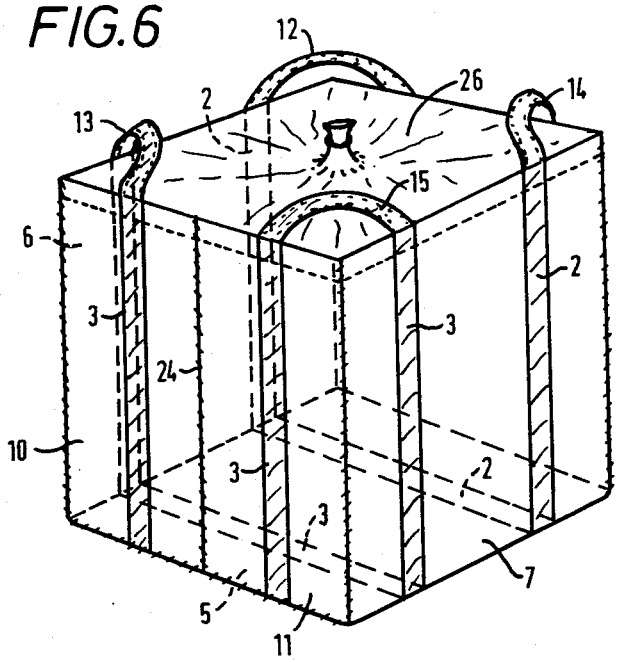

A contaner may be finished in any desired manner, for example it may be fitted with an inner liner and/or it may be fitted with a top such as the top 26 shown in FIG. 6 to protect the contents of the container. The base of the container may be formed with any suitable discharge arrrangement rendering the container suitable for emptying and refilling. Any such arrangement may be assembled into the base either at the blank stage, during any intermediate assembly stage or at the finished container stage. It will be understood that the order of assembly referred to in the foregoing description may be changed as desired, although it is found simpler to effect the wrapping of the connecting portions when the blank is flat.

Containers in accordance with the invention may be assembled other than from a single blank of material. In one such alternative two blanks may be used, each of half the base width and side wall width of the finished container, and thus effectively being the equivalent of the shape JXX'J' of FIG. 1. Half-containers may be assembled from each such blank and joined together to form a container at any convenient stage of the operation. In another alternative containers may be assembled from two blanks identical in form to shape GJKH and a square section of material that will form the base of the container and which may or may not be provided with reinforcing bands. Each of the blanks can be reassembled to the stage of FIG. 4, the two blanks then being joined to the base section and assembly continuing thereafter as previously described. Rather than use two blanks such as GJKH four blanks of a form given by the longitudinal division in half of the blank GJKH could be used, each blank again being partially assembled before being joined to other blanks and to a base section. Other forms of blanks from which containers according to the invention may be assembled are also possible as will be apparent to those skilled in the art.

I claim:

1. A flexible bulk container having a base and four side walls each joined to the base and to the two adjacent side walls, the container being formed from a single elongated strip of woven fabric of width substantially equal to the side wall width, the strip having two spaced parallel reinforcing bands extending longitudinally thereof and forming an integral part of the fabric, each band extending the full length of the strip and lying between the longitudinal centre line and a respective longitudinal edge of the strip, the strip having been cut away to leave connecting sections between strip sections which strip sections form the side walls of the container, each connecting section comprising a length of reinforcing band, the strip having been folded and stitched to form the container and to locate the connecting sections so that each extends between adjacent side panels over a respective corner of the bag and forms a lifting loop at that corner of the bag.

2. A flexible bulk container according to claim 1 in which the parts of the strip that have been cut away remain joined to respective connecting sections and are each wrapped around the joined connecting section and stitched thereto.

3. A flexible bulk container according to claim 1 in which the material of the base and walls is a woven fabric having interwoven polypropylene warp and weft yarn, and the bands include additional reinforcing warp threads having a higher tensile strength than the remaining warp yarns and interwoven with the weft yarns.

4. A flexible bulk container according to claim 1 in which opposed first and second side walls of the container are continuous extensions of the base, and each of opposed third and fourth side walls comprises two panels, each panel containing part of one of the reinforcing bands, the two panels being stitched together along a seam extending upwardly along the centre of the respective side wall and also being stitched to the base.

5. A flexible bulk container according to claim 4 in which each panel is also stitched along its upwardly extending edge to the upwardly extending edge of the adjacent one of the opposed first and second side walls.

6. A blank from which may be assembled a flexible bulk container having a base, four side walls extending upwardly from the base and four lifting loops each extending between adjacent side walls at a respective corner of the bag, the blank comprising an elongated strip of material of width substantially equal to the required base width and side wall width of the container, the strip having two spaced parallel reinforcing bands extending longitudinally thereof, each band extending the full length of the strip and lying between the longitudinal centre line and a respective longitudinal edge of the strip, the strip having a length that is at least equal to the base length plus four times the side wall height plus twice the lifting loop length of the container to be assembled, the blank, to each side of a notional transverse line that will be the transverse centre line of the base of the assembled container, extending continuously to a second notional transverse line for a distance equal to half the base length plus the side wall height and being formed with a central longitudinal cut extending from that second notional transverse line to the end of the strip.

7. A blank according to claim 6 in which the blank is modified so that between the second notional transverse line and a third notional transverse line lying between the second line and the adjacent end of the strip and spaced from the second line by the lifting loop length, the base fabric is cut, except over the width of the reinforcing bands.

8. A blank according to claim 7 in which the blank is further modified in that the cut base fabric attached to each reinforcing band is wrapped around that band and is stitched thereto.

9. A method of assembling a flexible bulk container having a base, four side walls extending upwardly from the base and four lifting loops, each extending between adjacent side walls at a respective corner of the container, the method comprising providing a blank, comprising an elongated strip of material of width substantially equal to the required base width and side wall width of the container, the strip having two spaced parallel reinforcing bands extending longitudinally thereof, each band extending the full length of the strip and lying between the longitudinal centre line of the strip and a respective longitudinal edge of the strip, the strip having a length that is at least equal to the base length plus four times the side wall height plus twice the lifting loop length, defining on the blank a first notional transverse line that will be the transverse centre line of the base, defining to each side of the first notional transverse line a second notional transverse line spaced from said first line by a distance equal to half the base length plus the side wall height, defining to each side of the first notional transverse line a third notional transverse line lying between the respective second notional transverse line and the adjacent end of the strip and spaced from the respective second notional transverse line by a distance equal to the lifting loop length, defining to each side of the first notional transverse line a fourth notional transverse line lying between the first line and adjacent second line at a distance from the first line equal to half the base length, effecting a central longitudinal cut from each second notional transverse line to the adjacent end of the strip, cutting the blank along each second and third notional transverse line except over the width of the reinforcing bands, wrapping the cut base fabric around the respective reinforcing band to which it is attached and stitching it thereto, folding the strip so that each end is moved into contact with the adjacent fourth notional transverse line and stitching together the two overlying plies of material along each edge of the strip, folding each corner defined by the junction of the longitudinal cut and the end of the strip to lie on the first notional transverse line, stitching the respective part of the end of the strip to the side of the strip between the first and fourth notional transverse lines, and stitching together along their respective longitudinal cuts the two panels folded in from the respective ends of the strip at the same side thereof to form a central seam extending up the centre of the container side wall formed by those panels.

* * * * *